US010323508B2

(12) United States Patent
Coles et al.

(10) Patent No.: US 10,323,508 B2
(45) Date of Patent: Jun. 18, 2019

(54) APPARATUS AND METHODS FOR MONITORING THE RETRIEVAL OF A WELL TOOL

(71) Applicant: Halliburton Energy Services, Inc., Houston, TX (US)

(72) Inventors: Randolph S. Coles, Spring, TX (US); Sushovon Singha Roy, Houston, TX (US); Batakrishna Mandal, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 639 days.

(21) Appl. No.: 14/768,444

(22) PCT Filed: Feb. 27, 2013

(86) PCT No.: PCT/US2013/028032

§ 371 (c)(1),
(2) Date: Aug. 17, 2015

(87) PCT Pub. No.: WO2014/133504

PCT Pub. Date: Sep. 4, 2014

(65) Prior Publication Data

US 2016/0003033 A1 Jan. 7, 2016

(51) Int. Cl.
*E21B 19/00* (2006.01)
*E21B 41/00* (2006.01)
(Continued)

(52) U.S. Cl.
CPC ..... *E21B 47/09* (2013.01); *E21B 19/00* (2013.01); *E21B 33/072* (2013.01); *E21B 41/0021* (2013.01); *E21B 47/091* (2013.01)

(58) Field of Classification Search
CPC ..... E21B 47/09–091
See application file for complete search history.

(56) References Cited

U.S. PATENT DOCUMENTS 4,023,092 A 5/1977 Rogers
4,698,631 A * 10/1987 Kelly ..... G01S 13/755
(Continued)

FOREIGN PATENT DOCUMENTS

EP 2463478 A1 * 6/2012 ..... E21B 47/12

OTHER PUBLICATIONS

International Search Report and Written Opinion dated May 3, 2013; PCT Application No. PCT/US2013/028032.

*Primary Examiner* — Blake E Michener
(74) *Attorney, Agent, or Firm* — McGuireWoods LLP

(57) ABSTRACT

A system to monitor the retrieval of a well tool from a wellbore comprises a deployment member coupled to the well tool to retrievably insert the well tool in the wellbore. At least one first identification transducer is coupled to a top end of the well tool to transmit an identification signal during retrieval of the well tool. At least one second identification transducer is located at at least one axial location along a surface pressure control assembly to detect the identification signal. A controller is in data communication with the at least one second identification transducer to determine the position of the well tool relative to the pressure control assembly, and to output at least one command related to the position of the well tool relative to the pressure control assembly.

19 Claims, 7 Drawing Sheets

(51) Int. Cl.
*E21B 47/09* (2012.01)
*E21B 33/072* (2006.01)

(56) References Cited

U.S. PATENT DOCUMENTS

| | | | | |
|---|---|---|---|---|
| 4,940,095 | A * | 7/1990 | Newman | E21B 19/22 |
| 5,934,371 | A | 8/1999 | Bussear et al. | |
| 7,503,398 | B2 * | 3/2009 | LoGiudice | E21B 17/1028 166/386 |
| 7,819,189 | B1 * | 10/2010 | Cosby | E21B 47/09 166/250.01 |
| 2002/0093431 | A1 * | 7/2002 | Zierolf | E21B 17/006 340/854.1 |
| 2003/0043055 | A1 * | 3/2003 | Schultz | E21B 41/0085 340/856.3 |
| 2003/0047316 | A1 * | 3/2003 | Bosley | E21B 43/122 166/372 |
| 2004/0011533 | A1 | 1/2004 | Lawrence et al. | |

* cited by examiner

APPARATUS AND METHODS FOR MONITORING THE RETRIEVAL OF A WELL TOOL

FIELD OF THE INVENTION

This invention relates generally to well equipment and well operations, and more particularly to apparatus and methods for the safe retrieval of downhole tools.

BACKGROUND OF THE INVENTION

During downhole well operations, for example in wells for producing petroleum products, a tool string comprising one or more well tools may be inserted into, and retrieved from, a well. The tools may be used to perform a number of well operations, for example well logging, well perforating, setting of well tools, etc. The tool string may be run on a deployment member. As the tool string is retrieved from downhole, and approaches the surface, it is necessary to control the speed and position from the surface of the tool string to safely dock the tool string in the surface equipment. If the tool string approaches too fast, it may impact the surface docking equipment. Such an impact may result in a tool pull-off where the tool string is separated from the deployment member causing a lost time event. In another scenario, the impact with the surface docking equipment may cause the tool string to get stuck in the surface docking equipment that may also cause a lost time event and/or a safety issue.

A number of well tools that may present surface safety hazards in certain malfunction scenarios. For example, perforating guns and tools with nuclear sources may create safety issues during certain malfunction mishaps. The identification of such tools, and the notice of their imminent arrival to the surface, may significantly enhance rig and personnel safety.

The present disclosure addresses at least some of these issues.

BRIEF DESCRIPTION OF THE DRAWINGS

A better understanding of the present invention can be obtained when the following detailed description of example embodiments are considered in conjunction with the following drawings, in which.

Figure 1:
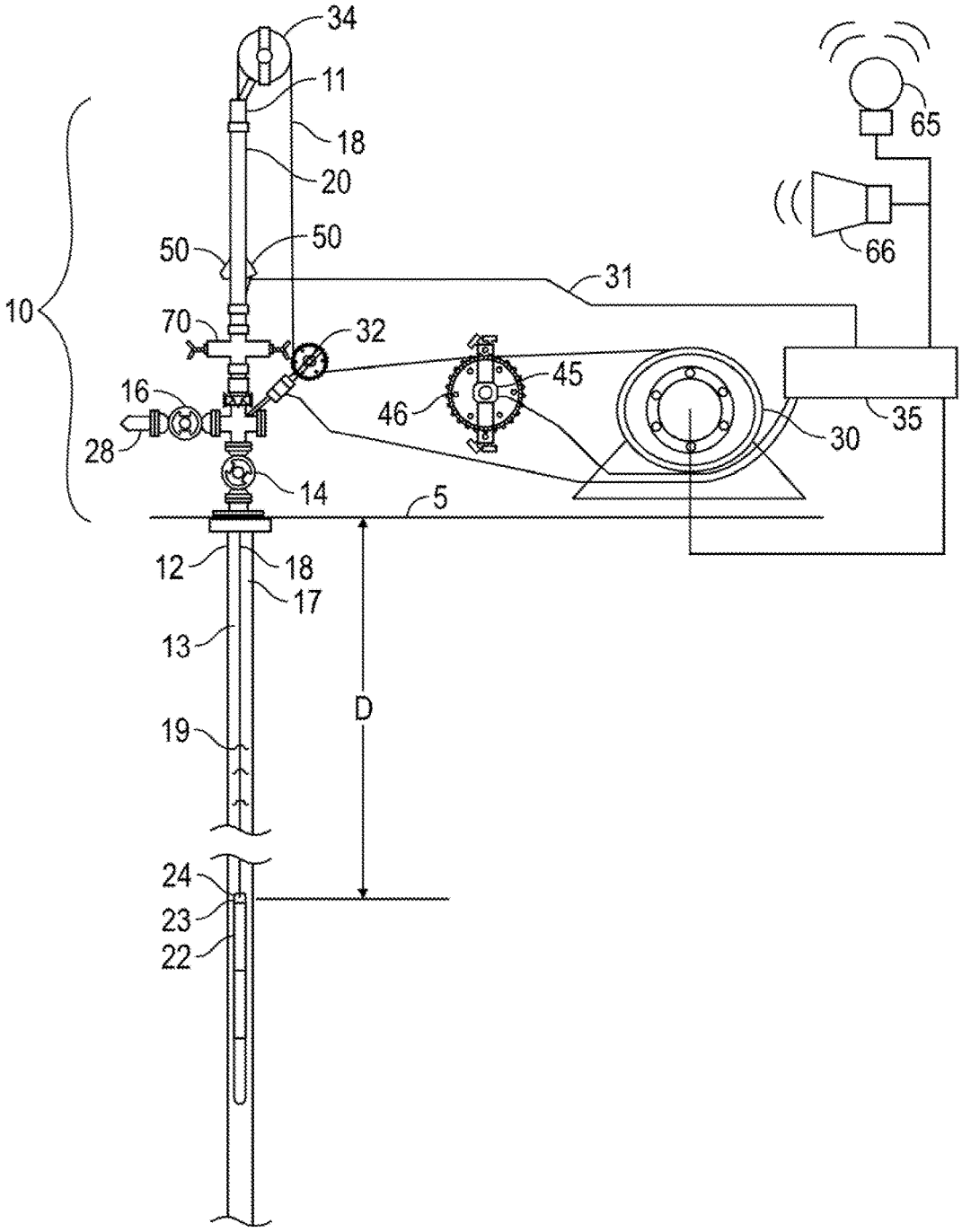
FIG. 1 shows an acoustic system for controlling the retrieval of a tool string.

While the examples shown are susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present disclosure as defined by the appended claims.

DETAILED DESCRIPTION

FIG. 1 shows a surface pressure control assembly 10 that is connected to the upper extremity of well casing 12. Surface pressure control assembly 10 may comprise at least one valve 14 for the purpose of shutting in the well 13, as desired; at least one wing valve 16 that controls the flow of production fluid from the well into a production line 28 extending to a suitable facility for receiving production fluid. In addition, surface pressure control assembly 10 may comprise a blowout preventer 70 for controlling pressure during well operations and a lubricator assembly 20 for introducing well tools into well 13. Well operations may occur during drilling, completing, and workover of well 13. Well tools may be inserted and extracted from well 13 in any of these operations.

Various tools may perform their intended operation during insertion, while at a particular location downhole, and during retrieval of the tool toward the surface. As such, the terms deploy, deployed, and deployment and any other derivatives, as used herein, are intended to refer to insertion and/or retrieval of a tool string. As used herein, the term deployment member is intended to comprise at least one of a wireline, a slickline, and a coiled tubing.

Figure 2:
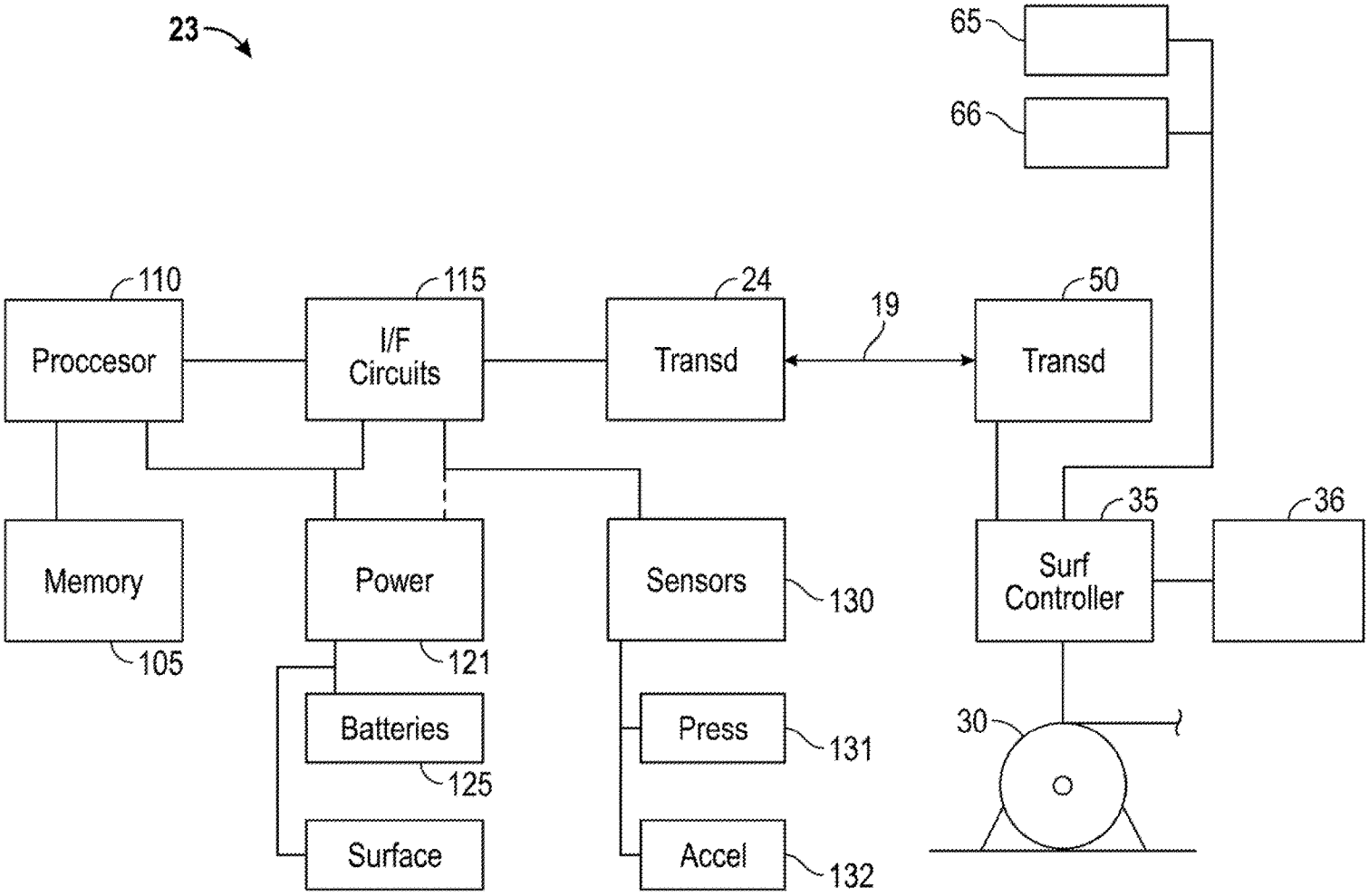
FIG. 2 shows a block diagram related to the system shown on FIG. 1.

Referring to FIGS. 1 and 2, a tool string 22 is connected to a deployment member 18, which for this example may be a wireline or slickline. As used herein, a wireline comprises braided strength members surrounding a core that contains one or more energy conductors. The energy conductors may comprise electrical conductors, optical fibers, and combinations thereof. The conductors may be configured as single conductors, stranded conductors, coaxial conductors, and combinations thereof. A slickline comprises a single strand strength member having a relatively smooth outer surface. While the slickline strength member may be metallic, it is not used to conduct electrical signals or power. Deployment member 18 is stored on, and deployed by, reel 30. Reel 30 is controlled from controller 35. Controller 35 may comprise suitable electronic circuits, a processor, and programmed instructions to accurately control the deployment of tool string 22.

In operation, deployment member 18 is run through lower sheave 32, through top sheave 34, through stuffing box 11, and is connected to tool string 22. Tool string 22 is lowered through lubricator assembly 20 into well 13. Stuffing box 11 seals around deployment member 18 and provides a secure pressure containing seal about deployment member 18 as it passes into and out of lubricator assembly 20.

In the example shown, deployment member 18 travels over a measuring wheel 46 that is coupled to a rotational sensor 45, for measuring the position and axial velocity of tool string 22 in well 13. Inaccuracies and/or failures in the measurement of tool string 22 position, and axial velocity, may lead to the problems described above during tool retrieval.

Tool string 22 may include an identification transducer assembly 23 located proximate the top end of tool string 22. Identification transducer assembly 23 may comprise at least one identification transducer 24 for transmitting an identification signal 19 for indicating the proximity of tool string 22 to a surface location. In one embodiment, the identification signal may comprise at least one of: an analog acoustic signal and a digitally encoded acoustic signal. For example, the generated acoustic signal may be a unique continuous predetermined frequency. Alternatively, the acoustic signal may comprise a digitally encoded signal. For example, the digitally encoded signal may comprise at least one of an amplitude shift signal, a frequency shift signal, and a phase shift signal. Information transmitted may comprise a tool identification number and a tool status. The tool status may include failure codes associated with tool functions. For example, a perforating gun may signal a misfiring of a charge, thereby alerting surface personnel to ensure that proper safety procedures are ready for handling of the tool upon retrieval to the surface. Other tools that may prevent safety hazards include, but are not limited to: neutron generators, tools with radioactive sources, and formation fluid and/or core sampling tools that store samples at downhole formation pressures.

In one example, referring to FIGS. 1 and 2, identification transducer assembly 23 may comprise an acoustic signal transducer 24. Identification transducer assembly 23 may also comprise a downhole processor 110 in data communication with a memory 105. Memory 105 may have stored instructions and data for execution by processor 110 for controlling the identification transmission. In addition, interface circuits 115 may comprise conversion and distribution from the power source 121 to processor 110 and transducer 24. In one example, power may be provided from the surface via an electrical wireline. In another example, power may be provided by a downhole battery 125 in tool string 22.

In one embodiment, acoustic signal transducer 24 may comprise a piezoelectric crystal that may be energized to generate an acoustic signal 19 at a predetermined frequency. Such piezoelectric acoustic signal transducers are know in the art, and are not described here in detail. The signal 19 propagates through the fluid 17 in well 13 to the surface. An acoustic receiver 50 may be attached to lubricator 20 to detect acoustic signal 19. The received signal 19 may be fed to controller 35 for processing.

Acoustic signal transducer 24 may be operated to transmit calibration signals during at least a portion of the tool string insertion onto the wellbore. For example, the amplitude of signals 19 received at surface transducer 50 may be detected at multiple known, or predetermined, locations as tool string 22 is inserted into well 13. A signal amplitude may be associated with a notification distance from the surface, D, for indicating the approach of tool string 22 during retrieval from the well 13. Those skilled in the art will appreciate that the notification distance D may be dependent on the type of tool and speed of the retrieval. A range of notification distance is between 200-1000 ft. In one example, a model of acoustic signal attenuation may be developed, in situ, to allow the acoustic signal versus distance from the surface to be modeled. Such a model may be input to controller 35 such that controller 35 continuously monitors surface receiver 50 and outputs the distance of tool string 22 from the surface when an acoustic signal is acquired. In one example, surface controller 35 may autonomously control the slowing and/or braking of reel 30 based on the distance from received acoustic signal 19. In addition, controller 35 may actuate an audible alarm 66 and/or a visual alarm 65.

In one embodiment, to conserve battery, identification transducer assembly 23 may comprise a sensor 130, for example, an accelerometer 132 that detects the retrieval of tool string 22 toward the surface. At the initiation of retrieval, identification transducer 24 may begin transmission of the acoustic identification signal 19. The detection of the signal, and subsequent action then proceeds as described above. In yet another example, a pressure sensor 131 may be included in identification transducer assembly 23 where the pressure transducer 131 is in fluid communication with the downhole fluid, and detects the downhole fluid pressure. If the wellbore pressure profile versus depth remains substantially static during the period of the deployment, then a trigger pressure may be programmed into the downhole processor 110. The trigger pressure may be used to initiate transmission of acoustic signals by acoustic signal transducer 24.

In one example, the frequency of acoustic signal 19 from acoustic transducer 24 may be selected such that at least a portion of the energy of acoustic signal 19 is coupled into well casing 12 such that the acoustic signal propagates to the surface through well casing 12.

Figure 7:
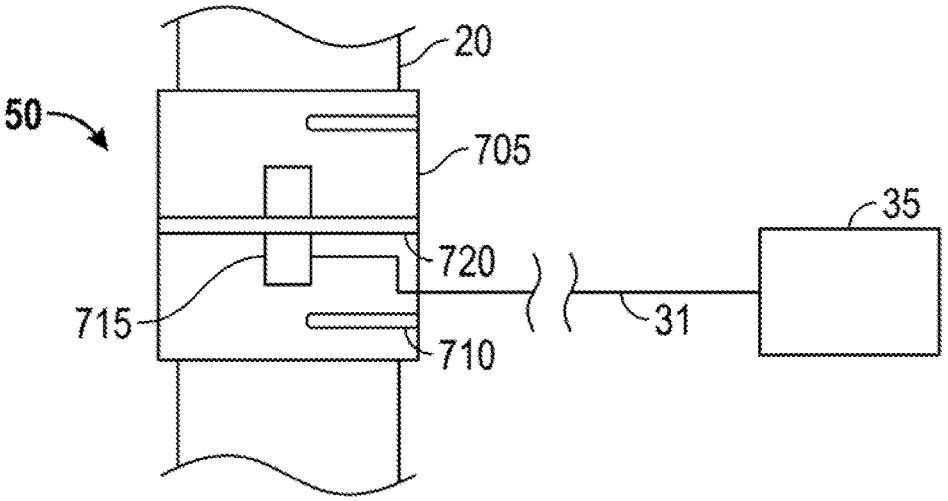
FIG. 7 shows an example of a strap on acoustic detector.
Figure 8:
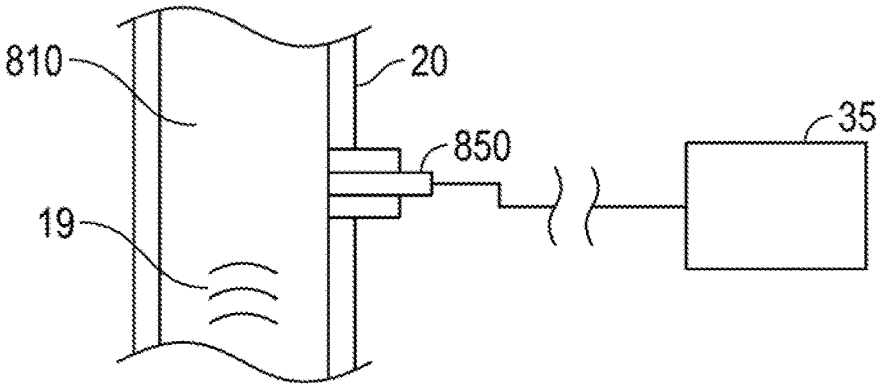
FIG. 8 shows an example of a pressure transducer for use as an acoustic signal detector.

Surface transducer 50 may comprise a piezoelectric element that is coupled to at least one of: the surface piping, the lubricator, and the casing near the surface. FIG. 7 shows one example of surface transducer 50. As shown, a flexible pad 705 is wrapped around lubricator 20. Pad 705 may be an elastomer material to acoustically couple the piezoelectric element 715 to the metallic lubricator tube 20. In the example shown, straps 710 hold flexible pad 705 firmly onto lubricator 20. Similarly, strap 720 holds piezoelectric element 715 against flexible pad 705. Electrical lead 31 couples piezoelectric element to suitable circuits in controller 35. Suitable piezoelectric element materials include, but are not limited to: lead zirconium titanate, quartz, and lead magnesium niobate-lead titanate. Alternatively, polymer film, for example, a polyvinylidene difluoride (PVDF) film material may be used as a piezoelectric film attached to pad 705. Alternatively, see FIG. 8, a pressure transducer 850 may be in hydraulic communication with the fluid 810 in lubricator 20 to detect the acoustic signal 19. Pressure transducer 850 may be a piezoelectric pressure transducer. Piezoelectric pressure transducers are commercially available, for example from Kistler Instruments, Corp., Novi, Mich., and are not described here in detail.

Figure 3:
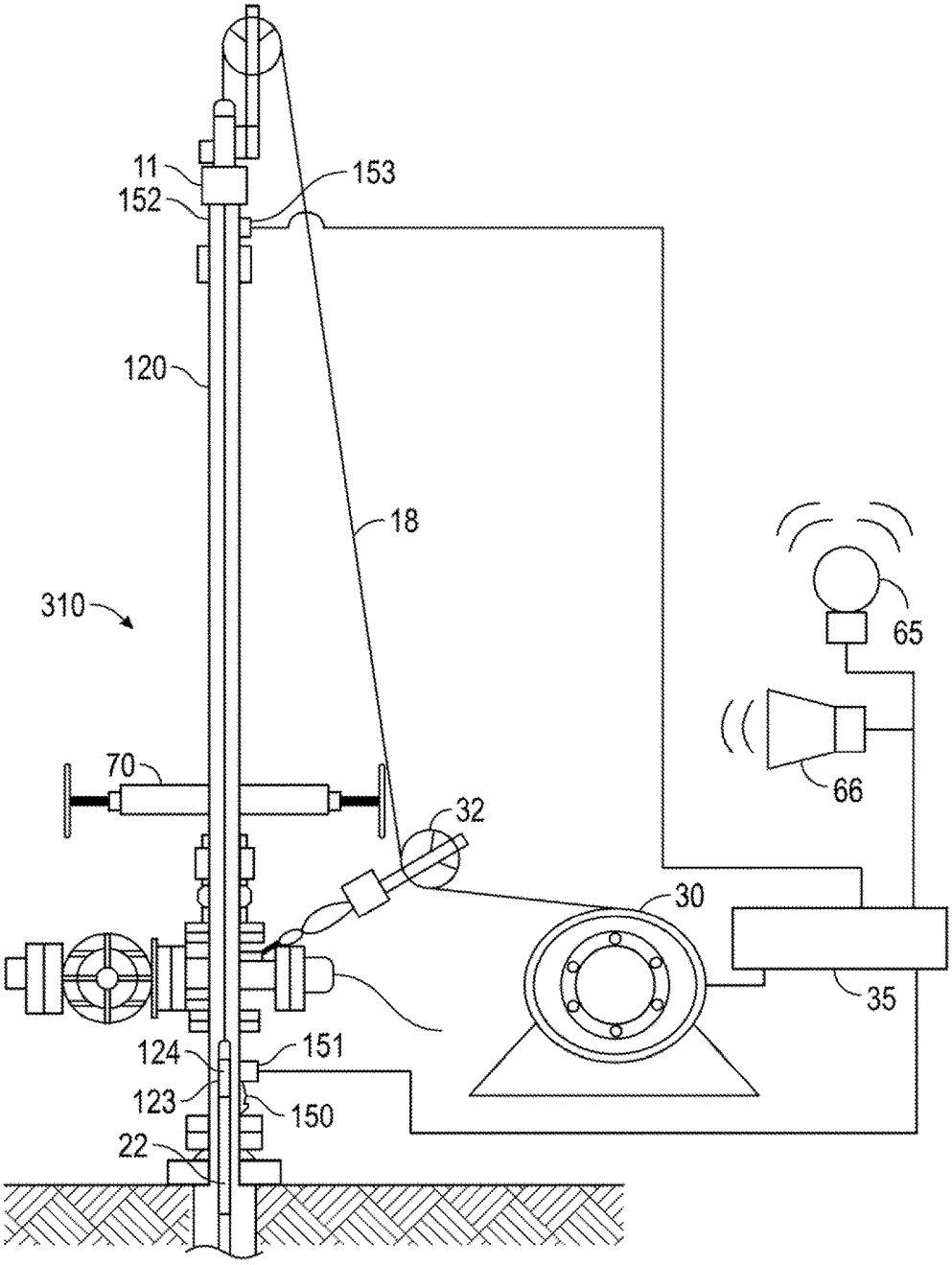
FIG. 3 shows a Radio Frequency Identification Device (RFID) embodiment of a system for monitoring the retrieval of a tool string.

FIG. 3 shows another embodiment of a system for controlling the retrieval of tool string 22 to surface 5 wherein identification transducers may comprise Radio Frequency Identification Devices (RFID). An RFID system may comprise a reader and a tag. In one example, the RFID reader transmits an encoded radio signal to interrogate the tag. The tag receives the interrogation message and responds with the tag's identification information. This identification information may comprise only a unique tag serial number, or it may also comprise additional information, for example, tool-related information.

RFID tags may be passive, active, or battery-assisted passive. An active tag has an on-board battery and periodically transmits its ID information. A battery-assisted passive (BAP) tag has a small battery on board and is activated when in the presence of a RFID reader. A passive tag uses the radio energy transmitted by the reader as its energy source. For a passive tag, the interrogator must be close enough for the RF field to be strong enough to transfer sufficient power to the passive tag.

Figure 4:
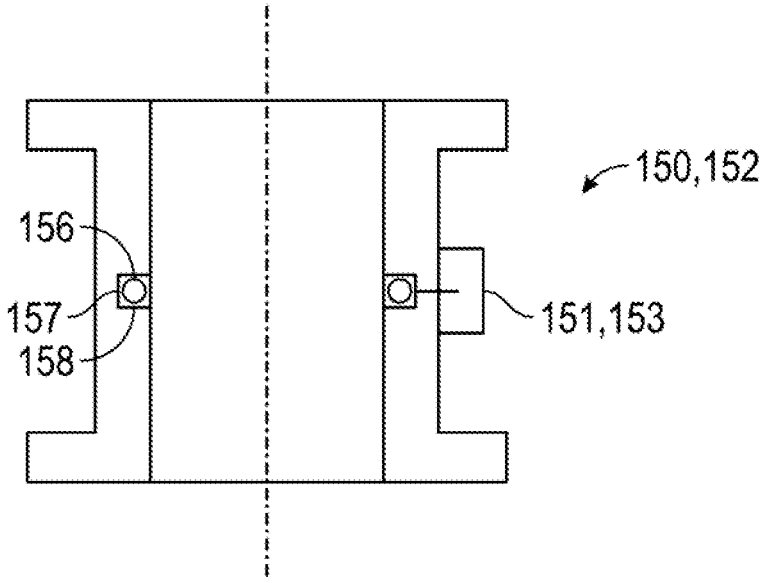
FIG. 4 shows an example of sensor spool for use with at least one embodiment of the present disclosure.

In one embodiment, still referring to FIG. 3, surface pressure control assembly 310 contains identification transducers that comprise a first RFID reader 151 located in a first sensor spool 150 between well head 140 and lubricator, and a second RFID reader 153 located in a second sensor spool 152 located between the top of lubricator 120 and stuffing box 11. FIG. 4 shows an example of sensor spool 150, 152, where an antenna wire 156 is located in groove 157 located circumferentially around an inside surface of spool 150, 152. Antenna wire 156 is electrically insulated from spool 150, 152 by an insulating material 158. Insulating material 158 may be any insulating material suitable for the downhole conditions, including, but not limited to, a rubber material, an epoxy material, an elastomeric potting material, and a polyether ether ketone material.

An RFID transmitter 124 is located in an RFID transmitter sub 123 located on the top of tool string 22. RFID transmitter 124 may be a passive or active transmitter as described above. In one example, deployment member 18 may be a wireline that has an electrical conductor, and transmits power from the surface controller to tool string 22 and RFID transmitter 124. Alternatively, for the case where surface power to tool string 22 is unavailable, batteries may be used to power RFID transmitter 124.

As tool string 22 enters first sensor spool 150, a predetermined identification transmission from RFID transmitter 124 is received by RFID reader 151, and forwarded to surface controller 35. Surface controller 35 processes the received signal and acts according to instructions stored in memory 36 to output the appropriate alert related to the position of tool string 22. In one embodiment, tool string 22 proceeds sufficiently far into lubricator 120 such that RFID tag 124 communicates with RFID reader 153 and sends a related signal to processor 35. Processor 35 may use this command to determine that the tool is completely docked in lubricator 120. In one example, controller 35 may autonomously issue a command to slow down and/or brake the rotation of reel 30 to ensure the safe docking of tool string 22. In one example, controller 35 may trigger an audible and/or visible warning to a winch operator. In another example, when controller 35 detects that tool string 22 is safely docked in lubricator 120, controller 35 may automatically close rams 70 to isolate the tool from well 13.

Figure 5:
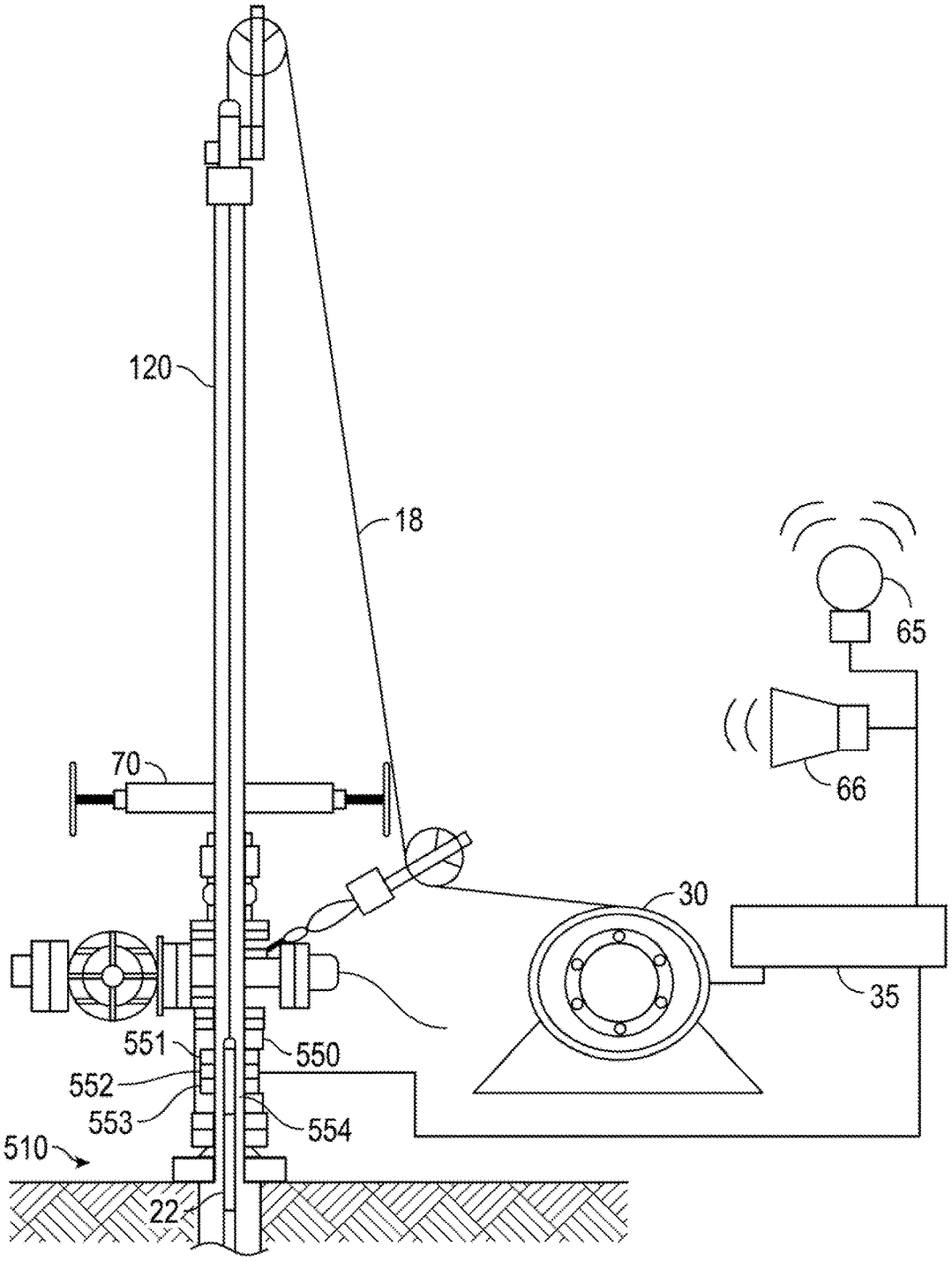
FIG. 5 shows a magnetic detector embodiment of a system for monitoring the retrieval of a tool string.
Figure 6:
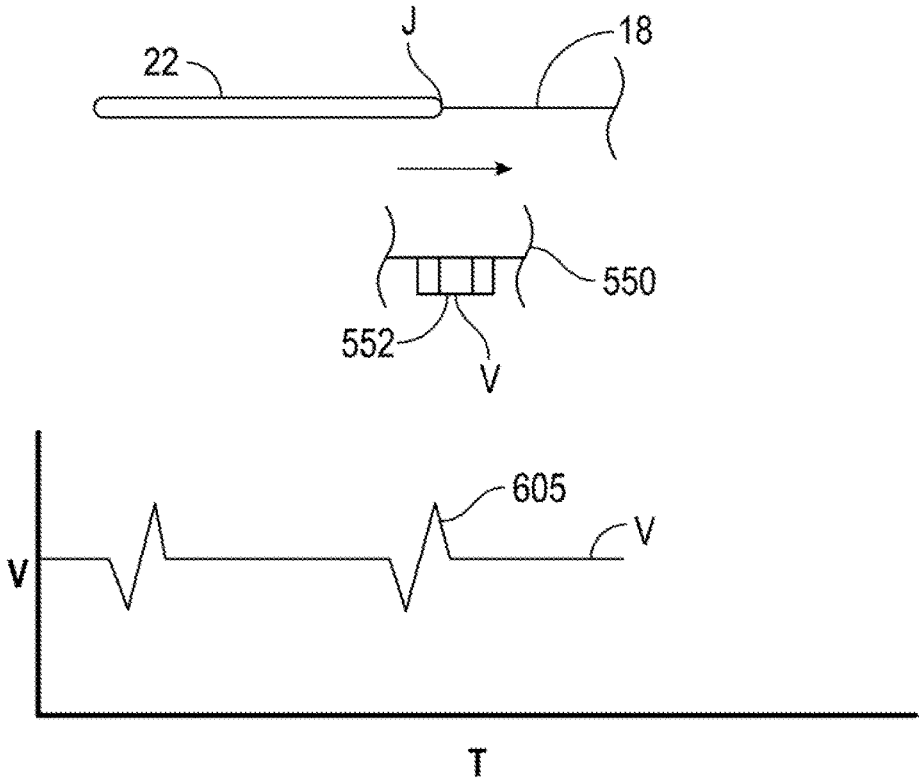
FIG. 6 shows a signal detection example using the embodiment of FIG. 6.

In yet another alternative embodiment of a tool retrieval alert system, see FIG. 5, an electromagnetic sensor system 510 may be used to detect the passage of a metallic object, for example a tool string 22. In one example, electromagnetic sensor sub 550 comprises two permanent magnets 551 and 553, separated by a coil 552. The magnetic fields of magnets 551 and 553 establish flux lines in the axial bore 554 that also pass through the wires of coil 552. The passage of metallic objects through axial bore 554 disturbs the magnetic field such that the flux lines cross the wires of coil 552. A voltage is generated in the coil wires, where the voltage is related to the time rate of change of the flux lines across the coil wires. The principle is similar to that of casing collar locators used in well logging. In operation, see FIG. 6, as the wireline 18 and tool string 22 move past sensor sub 550, the change in metallic mass at the junction, J, of wireline 18 and tool string 22 induces a voltage spike 605 in coil 552 that may be detected by controller 35. The detected voltage spike 605 may be used to trigger suitable alarms and commands per the instructions programmed into controller 35.

While described above, with reference to a wireline deployment, one skilled in the art will appreciate that the same retrieval detection and alert techniques are similarly applicable to slickline, coiled tubing, and jointed pipe deployments of similar tools.

What is claimed is:

1. A system to monitor the retrieval of a well tool from a wellbore, comprising a deployment member coupled to the well tool to retrievably insert the well tool in the wellbore;

at least one first identification transducer coupled to a top end of the well tool to transmit identification signals during retrieval of the well tool;

at least one second identification transducer located at at least one axial location along a surface pressure control assembly to continuously detect the identification signals during retrieval of the well tool; and a controller in data communication with the at least one second identification transducer to determine the vertical depth of the well tool relative to the pressure control assembly, and to output at least one command related to the position of the well tool relative to the pressure control assembly;

wherein the identification signals comprise encoded tool status information including failure codes associated with tool functions.

2. The system of claim 1 wherein the deployment member is chosen from the group consisting of: a wireline; a slickline; and a coiled tubing.

3. The system of claim 1 wherein the at least one first identification transducer and the at least one second identification transducer are each chosen from the group consisting of: an acoustic transducer and a radio frequency transducer.

4. The system of claim 1 wherein the well tool comprises at least one of: a perforating gun; a pulsed neutron tool; a logging tool; and a tool with radioactive nuclear source.

5. The system of claim 1 wherein the identification signal comprises at least one of: an analog acoustic signal; a digitally encoded acoustic signal; an analog radio frequency signal; and a digitally encoded radio frequency signal.

6. The system of claim 1 wherein the at least one second identification transducer is an acoustic transducer comprising a piezoelectric element acoustically coupled to the surface pressure control assembly to detect the identification signal.

7. The system of claim 1 wherein the at least one first identification transducer is a radio frequency identification device (RFID) tag and the at least one second identification transducer is an RFID reader.

8. The system of claim 7 wherein the at least one second identification transducer comprises at least two RFID readers spaced apart axially along the surface pressure control assembly to monitor the position of the well tool in the surface pressure control assembly.

9. The system of claim 1 wherein the at least one command activates at least one of: an audible alarm; a visible alarm; and a brake coupled to a reel to control the speed of the tool retrieval.

10. The system of claim 1 wherein the identification signal comprises a tool identification number.

11. The system of claim 1 wherein the distance is determined based on the amplitude of the identification signals.

12. A method for monitoring the retrieval of a well tool from a wellbore, comprising disposing at least one first identification transducer at a top end of the well tool;

disposing at least one second identification transducer at at least one predetermined location along a surface pressure control assembly;

retrieving the well tool from the wellbore;

transmitting identification signals during retrieval of the well tool;

detecting, continuously, the transmitted identification signals during retrieval of the well tool at the at least one second identification transducer;

determining with a controller in data communication with the at least one second identification transducer a vertical depth of the well tool relative to the surface pressure control assembly; and outputting at least one command related to the position of the well tool relative to the surface pressure control assembly;

wherein the identification signals comprise encoded tool status information including failure codes associated with tool functions.

13. The method of claim 12 further comprising deploying the well tool on a deployment member chosen from the group consisting of: a wireline; a slickline; and a coiled tubing.

14. The method of claim 12 wherein the at least one first identification transducer and the at least one second identification transducer are each chosen from the group consisting of: an acoustic transducer and a radio frequency transducer.

15. The method of claim 12 wherein the well tool comprises at least one of: a perforating gun; a pulsed neutron tool; a logging tool; a tool with an active nuclear source; or a tool conveyed in a well using wireline, slickline, or coiled tubing.

16. The method of claim 12 wherein the identification signal comprises at least one of: an analog acoustic signal; a digitally encoded acoustic signal; an analog radio frequency signal; and a digitally encoded radio frequency signal.

17. The method of claim 12 wherein the at least one second identification transducer is an acoustic transducer comprising a piezoelectric element acoustically coupled to the surface pressure control assembly to detect the identification signal.

18. The method of claim 12 wherein the at least one first identification transducer is a radio frequency identification device (RFID) tag and the at least one second identification transducer is an RFID reader.

19. The method of claim 18 wherein the at least one second identification transducer comprises at least two RFID readers spaced apart axially along the surface pressure control assembly to monitor the position of the well tool in the surface pressure control assembly.

* * * * *